United States Patent [19]

Yamada

[11] Patent Number: 4,928,146

[45] Date of Patent: May 22, 1990

[54] DEVELOPING DEVICE

[75] Inventor: Takanobu Yamada, Osaka, Japan

[73] Assignee: Minolta Camera Co., Ltd., Osaka, Japan

[21] Appl. No.: 330,195

[22] Filed: Mar. 29, 1989

[30] Foreign Application Priority Data

Apr. 1, 1988 [JP] Japan ..... 63-81974
Apr. 4, 1988 [JP] Japan ..... 63-83501

[51] Int. Cl.[5] ..... G03G 15/09; G03G 15/01

[52] U.S. Cl. ..... 355/253; 355/326; 355/245; 118/657

[58] Field of Search ..... 355/326, 327, 245, 251, 355/253, 259; 118/645, 653, 656, 657, 658

[56] References Cited

U.S. PATENT DOCUMENTS 4,699,495 10/1987 Hilbert ..... 355/253
4,752,802 6/1988 Ito et al. ..... 355/3 DD
4,816,870 3/1989 Nagayama ..... 355/251
4,841,336 6/1989 Kusumoto et al. ..... 355/245
4,851,873 7/1989 Sakao et al. ..... 355/245
4,860,053 8/1989 Yamamoto et al. ..... 355/251 X

FOREIGN PATENT DOCUMENTS 61-208063 9/1986 Japan .

*Primary Examiner*—R. L. Moses
*Attorney, Agent, or Firm*—Willian Brinks Olds Hofer Gilson & Lione

[57] ABSTRACT

An interlocking mechanism for use in a developing device actuates a mechanism for regulating the condition of the developer on a developing roll correlatively with the movement of a developing unit from a developer supply location to a developer non-supply position and regulates to lower the height of the developer at the position where the developing roll faces the outside of the developing unit.

The interlocking mechanism also stops the action of a structure which regulates the condition of developer correlatively with the movement of the developing unit from the developer non-supply position to the developer supply location.

18 Claims, 6 Drawing Sheets

DEVELOPING DEVICE

BACKGROUND OF THE INVENTION

1. Technical Field of the Invention

The present invention relates to developing devices for use in such image forming apparatus as various kinds of copying machines and laser printers for forming monocolor images or colored images by selectively using desired colors, and more particularly to a developing device provided with a plurality of developing units accommodating different colored toners.

2. Brief Description of Related Art

Generally, a color copying machine for forming colored image is designed to form a colored image by using four colored developers, and developing units accommodating each colored developer are disposed in a developing device in one of the following three methods.

(1) Stationary Method: Each developing unit is disposed at a predetermined position around a photoconductor for selective use.

(2) Rotary Method: Each developing unit is disposed on a rotary support member and a desired developing unit is positioned at a developing location opposite to a photoconductor by rotating the rotary support member.

(3) Reciprocative Movement Method: Each developing unit is disposed on a reciprocative movement support member, and a desired developing unit is positioned at a developing location opposite to a photoconductor by reciprocatively moving the reciprocative movement support member.

The stationary method has problems that the diameter of the photoconductor becomes large and that there occurs attenuation variation of electrostatic latent images with the passage of time because of the difference in distance between the position where each electrostatic latent image is formed and the developing location of each color, and it has to be rectified.

The rotary method is able to solve the above-mentioned problems inherent in the stationary method, however, there is a problem that toner supply can not be performed efficiently since developer tends to easily fall out of a developing unit when a rotary support member is rotated with developing units mounted thereon and toner is supplied only to a developing unit which is positioned at a predetermined rotative position.

The reciprocative movement method has the disadvantageous point that it has to provide a little larger space in the direction of reciprocating movement compared with the rotary method. However, it is provided with characteristics which can solve the problems inherent in the rotary method. Especially it is arranged for stirring and supplying toners to each developing unit even when developing operation is not being performed. It is, therefore, very advantageous for use in forming colored images where more toners are consumed than the case when monocolor images are formed.

Incidentally, in the developing device of the reciprocative movement method, the developing units which are not performing developing process are separated from the photoconductor unlike the stationary method. It is, therefore, principally not necessary for the developing unit to lower the height of developer accommodated therein at the location of development.

However, it may happen to compact and harden the developer when the developing unit is moved from an undeveloping position to the developing location again. Once the developer is hardened, it causes to clog a height regulating plate resulting in the void on an image. Such blocking phenomenon is apt to occur easily since the developer toner is finely prepared for more improved accuracy for developing process.

Even the developing units at the position outside the developing location, when the developer accommodated therein has its height sufficient for the development at the position facing outside of a developing roll, developer may happen to fall out of the developing unit when it is moved and stopped or by shock and vibration caused by some other reason. The developer fallen out of the developing unit sticks to the leading end portion of the unit opposite to a photoconductor and stains the inside of a copying machine. The developer adhered to the front end portion of the developing unit is attracted by the electric potential on the side of the photoconductor apart from the supply of developer from a developing roll when the developing unit is moved to the location of development and faced the photoconductor, and sticks to the photoconductor thereby staining an image.

Japanese Published Patent Applications TOKKAI SHO 61-208063 and TOKKAI SHO 55-115063 disclose developing devices capable of solving the problems. The former is designed to lower the height of developer on a developing roll at the portion adjacent to the photoconductor especially when the developing unit is positioned at the developing location opposite to the photoconductor by changing the positions of magnets arranged in the developing roll at the times of development and undevelopment, while the latter is provided with a shutter blade which is actuated for scraping off the developer on the developing roll when the developing unit is not positioned at the developing location.

These developing devices are arranged to switch the positions of magenets and shutter blade corresponding to the position of the developing unit by controlling a driving mechanism specially provided. However, it invites a rise in manufacturing cost since the special driving and control mechanisms have to be provided on each one of the developing units. Especially for the color image forming apparatus, considerable rise in manufacturing cost is inevitable since it is provided with many developing units.

SUMMARY OF THE INVENTION

The main object of the present invention is to provide a developing device which is capable of solving the conventional problems by properly regulating the condition of developer around a developing roll at the time when development is performed and at the time when development is not performed without necessitating special driving mechanism and control.

Another object of the present invention is to provide a developing device which is capable of properly regulating the condition of developer around a developing roll simply and accurately by mechanically interlocking with positional switching action of each developing unit when it is at the location of operation of the developing position opposite to a photoconductor and when it is not at the location of operation of the developing position.

A further object of the present invention is to provide a developing device which is capable of properly regulating the condition of developer around a developing roll simply and accurately by mechanically interlocking with positional switching action of each developing unit when it is at the location of development opposite to a photoconductor and when it is not at the developing location.

Still another object of the present invention is to provide a developing device which is capable of accomplishing each one of the above-mentioned objects by adopting a shutter method and a rotative method of a developing roll known well for properly regulating the state of developer around a developing roll.

These and other objects and features of the present invention will become more apparent from the following description taken in conjunction with the accompanying drawings which illustrate specific embodiments of the invention.

BRIEF DESCRIPTION OF THE DRAWINGS

It is to be noted that like members and units used in each embodiment are designated by like numerals and symbols, and repeated description are omitted.

DESCRIPTION OF THE PREFERRED EMBODIMENT

Embodiments of the present invention will now be described below with reference to accompanying drawings.

Figure 1:
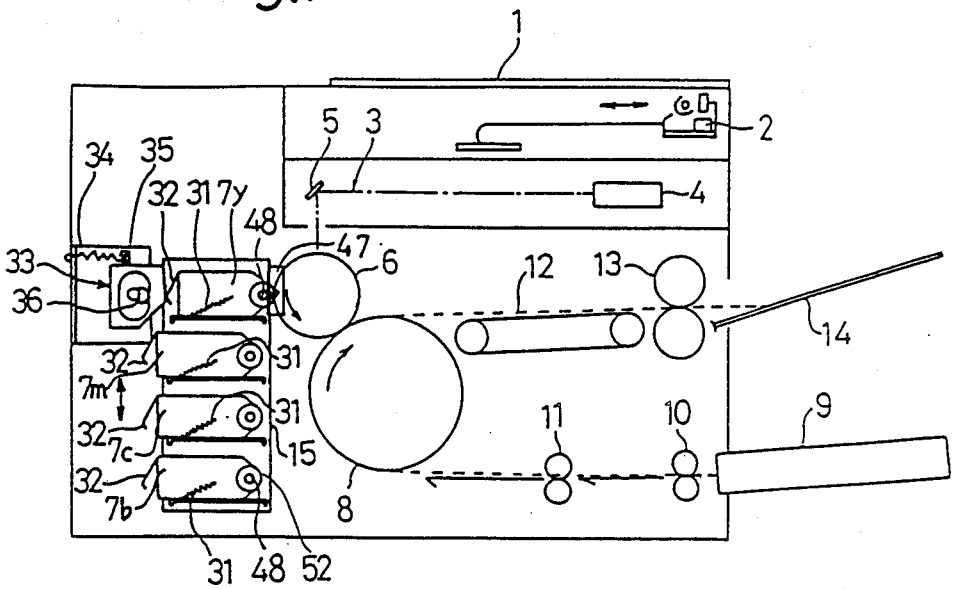
FIG. 1 is a schematic whole structural view showing a first embodiment of the present invention which is applied to a color copying machine.

FIG. 1 shows the whole structure of a color copying machine to which a first embodiment of the present invention is applied. An original placed on an original glass table 1 is read as color signals of three primary colors by a CCD line sensor 2. Each color signal is converted into four signals of Y (yellow), M (magenta), C (cyan) and B (black) by an image processing circuit and its output signal is transmitted to a laser optical system 3.

From a laser light generating device 4 in the laser optical system 3, laser light for forming images of each color corresponding to the signals of Y,M,C and B is irradiated. The laser light is then directed through a reflector 5 to a photoconductor 6 which rotates in the direction of the arrow, and image exposure is performed.

On the surface of the photoconductor 6, a latent image is formed by the image exposure. For the latent image formed corresponding to the signal Y, yellow toner Y is supplied from Y developing unit *7y* and an yellow toner image is formed on the photoconductor 6. In the same manner, each colored toner is supplied from M developing unit *7m*, C developing unit *7c*, and B developing unit *7b* thereby forming magenta toner image, cyan toner image and black toner image respectively for the latent images formed corresponding to the signal M, signal C and signal B.

A sheet of copy paper fed from a paper cassette 9 and transported by transport rollers 10,11 is wrapped around a transfer drum 8. Onto the paper wrapped around the transfer drum 8, each colored toner image on the photoconductor 6 is successively transferred by rotation of the transfer drum 8 with required number of rotations. The toner images of each color being transferred are composed on the copy paper and a colored toner image is formed thereon. The copy paper on which a colored toner image is formed is separated from the transfer drum 8 and is then transported through a transfer belt 12 to a fixing roller 13 where the colored toner image is fixed and then discharged to a discharge tray 14.

Figure 2:
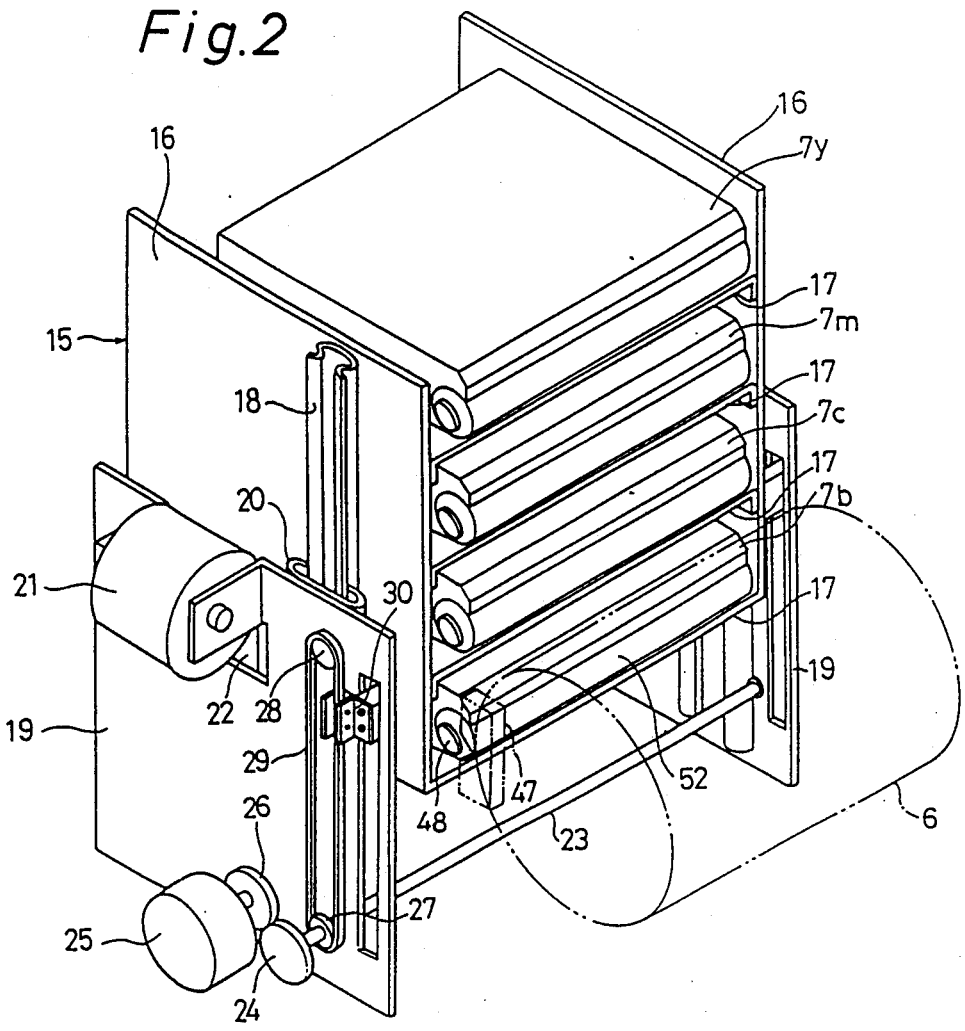
FIG. 2 is an enlarged perspective view illustrating a developing device of a color copying machine.

Each color developing unit, *7y*, *7m*, *7c* and *7b* (hereinafter called as developing unit 7 when each developing unit is generically called) is vertically supported by an elevation support member 15 in four stages. As shown in FIG. 2, the elevation support member 15 is provided with two sheets of sideboard 16 and four sheets of developing unit support board 17. On each one of the developing unit support boards 17, each developing unit *7y*, *7m*,*7c* and *7b* is placed, and they are movably supported and guided back and forth.

The elevation support member 15 is provided with rails 18 mounted on the sideboards 16 and fitted into rails 20 mounted on a pair of stationary boards 19 fixed on the main body of the machine. The elevation support member 15 is vertically movably supported and guided in a fitting relation between the rails 18,20.

A balancer 21 is mounted on the stationary board 19, and the tip portion of a spring sheet 22 of the balancer 21 is attached to the elevation support member 15 so as to always maintain a balanced state irrespective of any vertical position of the elevation support member 15.

A driving shaft 23 is hung at the lower portion of the stationary boards 19, and a gear 24 fixed to one end of the shaft is engaged with a driving gear 26 of a DC motor 25. Adjacent to both ends of the driving shaft 23, driving sprockets 27 are fixed, and chains 29 are wound around between sub-sprockets 28 held on the upper portion of the stationary boards 19. The chain 29 and the elevation support member 15 are connected with couplers 30. The elevation support member 15 is thus moved to a predetermined height of position by driving the chain 29 with the DC motor 25. Accordingly, a desired developing unit 7 can be positioned to face the photoconductor 6.

Each developing unit 7 placed on the developing unit support board 17 is biased backward by a spring 31 and is stopped at a predetermined retreated position by an unillustrated stopper. At the back end portion of the developing unit 7, a flat spring 32 which is bended in < shape is fixed.

FIG. 1 shows a state when the uppermost developing unit 7*y* is positioned opposite to the photoconductor 6, where a developing unit position switching means 33 is provided at the back of the developing unit 7*y* for advancing the developing unit 7 to the developer supply position opposite to the photoconductor 6.

Figure 3:
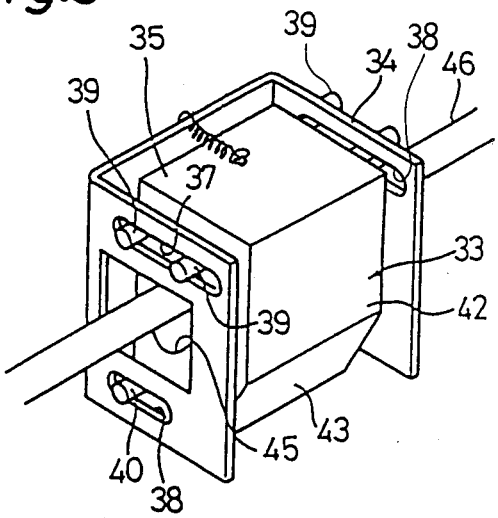
FIG. 3 is a perspective view showing a guide means which moves a developing unit which has reached a developing location to a location of operation.

The developing unit position switching means 33 is provided with, as shown in FIGS. 1 and 3, a stationary frame 34 fixed to the main body of the machine, a moving cam 35 movably supported and guided back and forth by guiding long grooves 37,38 with guide pins 39,40, and an eccentric driver 36 for moving the moving cam 35 back and forth.

The front of the moving cam 35 is formed by a vertical plane 42 at the upper portion and an inclined plane 43 at the lower portion. The moving cam 35 is provided with hollow portion 45 where the eccentric driver 36 is positioned, and the front wall of the hollow portion 45 is pressed to contact the eccentric driver 36 by a spring 44 to move the moving cam 35 back and forth by rotation of the driver 36. The eccentric driver 36 is fixed to a cam driving shaft 46, and the cam driving shaft 46 is rotatively controlled by unillustrated motor and clutch.

In order to accurately position the developing unit 7 advanced to a developer supply position at the developer supply location, position regulating members 47 provided with V shape positioning grooves are disposed on both sides of the photoconductor 6, and positioning rollers 48 are fixed on both sides of the developing unit 7 as shown in FIGS. 1 and 2. Accordingly, when the developing unit 7 is advanced by the eccentric driver 36 through the moving cam 35, the developing unit 7 is accurately positioned at the developer supply position by the positioning rollers 48 and the position regulating member 47 (refer to FIG. 5 ). When the eccentric driver 36 is retreated, the developing unit 7 is also retreated and engagement with the position regulating member is released thereby causing the developing unit to move freely upwardly and downwardly (refer to FIG. 4).

Figure 4:
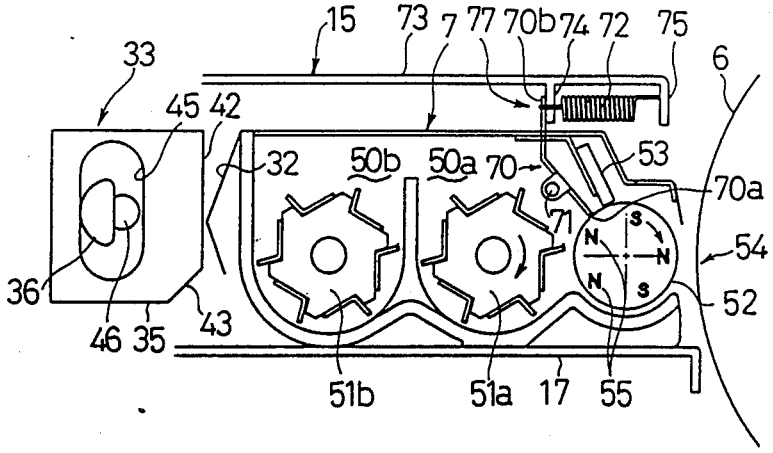
FIG. 4 is an expanded sectional view showing a state when a developing unit is not at a location of operation of a developing position.
Figure 5:
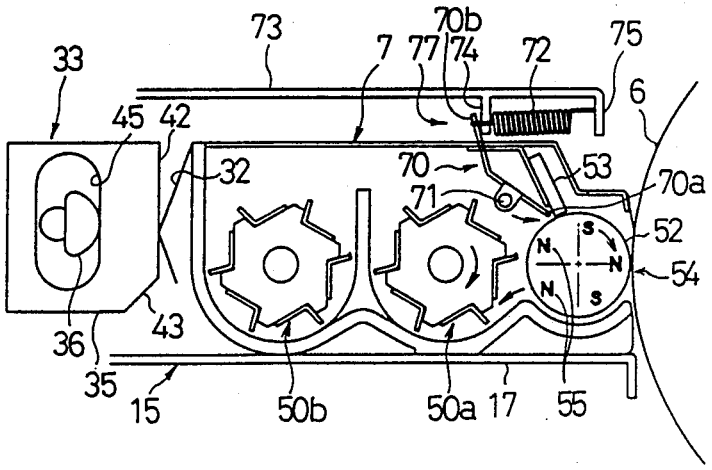
FIG. 5 is an expanded sectional view showing a state when a developing unit is at a location of operation of a developing position.

As illustrated in FIGS. 4 and 5, each developing unit 7 supplies developer to a developing roll 52 from bucket sections 50*a*, 50*b* provided with stirring means 51*a*, 51*b*. The developing roll 52 transports the developer by magnets stored therein (magnetic pole is only shown) in the direction of the arrow (FIG. 5) under a state that magnet is absorbed. Accordingly, the developer is transported to the developing section opposite to the photoconductor 6, wherein the height of the developer passing through is regulated by a height regulating plate 53. The developer used for developing process is removed at non-magnetic portion 55 of the developing roll 52 and is returned to the bucket section 50*a* again. The developer is then mixed and stirred with new toner and thereafter is supplied to the developing roll 52. The stirring means 51*a*, 51*b* and the developing roll 52 are always rotatively driven by an unillustrated motor.

In FIGS. 4 and 5, the numeral 70 designates a shutter which is arranged to obstruct or limit the movement of developer from the bucket section 50*a* of the developing unit 7 to the developing roll 52. The shutter 70 is pivotally supported by a shaft 71 at its central portion, and the lower end portion 70*a* is movably arranged toward and away from the developing roll 52. The upper end portion 70*b* of the shutter 70 is fastened to one end of a tension spring 72 and the shutter is biased to the clockwise direction.

A ceiling plate 73 is fixed to the elevation support member 15 so as to positioned above each developing unit 7 (the developing unit support plate 17 may also be used as the ceiling plate).

A stopper portion 74 is downwardly and protrusively provided on the ceiling plate 73 for regulating the pivotal movement of the shutter 70 at a predetermined position by the tension spring 72. The other end of the tension spring 72 is fastened to a front end bent portion 75 of the ceiling plate 73.

A shutter position switch means 77 comprised of the tension spring 72 and the stopper portion 74 switches over the shutter 70 to the operating position as shown in FIG. 4 when the developing unit 7 moves from the deloper supply location to a retreated position. At this stage, the upper end portion 70*b* contacts and is parallel with the stopper portion 74, and the lower portion 70*a* contacts the developing roll 52. Accordingly, the developer supplied and transported from the bucket section 50*a* to the developing roll 52 is scraped off by the shutter 70 and is not transported to the developing section 54.

On the other hand, when the developing unit 7 is moved from the retreated position to the developer supply location, the shutter position switch means 77 switches over the shutter 70 to the non-operating position as shown in FIG. 5. In other words, when the developing unit 7 is advanced, the upper end portion 70*b* of the shutter 70 is obstructed by the stopper portion 74 thereby pivotally moving the shutter 70 counterclockwise, while the lower end portion 70*a* of the shutter 70 loses contact with the developing roll 52. Accordingly, the developer supplied from the bucket section 50*a* to the developing roll 52 is transported to the developing section 54.

Now, a function of the device will be described. The elevation support member 15 is raised from the lowermost position to have a desired color developing unit 7 positioned opposite to the photoconductor 6, and then the developing unit 7 is moved forward to be positioned at the developer supply position with the developing unit switch means 33. Then, the shutter 70 is switched over to the non-operating position as shown in FIG. 5, and the developer stirred in the bucket sections 50*a*, 50*b* is supplied to the developing roll 52 without having any obstruction by the shutter 70. Thereafter, the developer is transported to the developing section 54 after being regulated by the height regulating plate 53. A latent image on the photoconductor 6 is thus visualized by toner. The visualized toner image is transferred onto a copy paper on the transfer drum 8. The developer used for the developing process is removed from the developing roll 52 at the non-magnetic section 55 to return to the bucket section 50*a*.

When the developing process is finished by the developing unit 7, the developing unit 7 is released from the pressure of the developing unit position switch means 33 and is moved backward by a spring 31. Then, the shutter 70 is switched over to the operating position as shown in FIG. 4, and the movement of the developer to the developing roll 52 is stopped thereby causing the height of the developer on the developing roll 52 to be covered.

In the meantime, the stirring of the developer is always carried out by continual rotation of the stirring means 51*a*, 51*b* and the developing roll 52. Sufficient stirring is thus ensured, and toner density of the developer in the developing unit 7 is advantageously maintained constant.

In the same manner as above-mentioned, when the next developing unit 7 is moved backward after developing process, the developer on the developing roll 52 runs out or the height of the developer is lowered. Thus, even if the developing unit 7 is positioned opposite to the photoconductor 6 and moved forward to the developer supply location, there is no problem of compacting and hardening the developer since the developer is run out or the height of the developer is lowered on the developing roll 52. Accordingly, there is no problem of occurrence of a void on an image.

Moreover, fall out of the developer caused by shock and vibration is prevented at the time when the elevation support member 15 and the developing unit 7 start or stop their action. Accordingly, the problem of staining the leading end portion of the developing unit 7 and the inside of the copying machine can be solved, and further when the developing unit 7 is positioned at the developing and the operating location, the toner sticked to the front end portion of the developing unit 7 is attracted by electric potential of the photoconductor 6 thus avoiding stains on an image.

FIGS. 6 through 10 illustrate a second embodiment of the present invention which is applied to almost the same type of a copying machine as shown in FIG. 1 of the first embodiment of the present invention. Each developing unit 7 is also basically the same as the ones in the first embodiment of the present invention.

Figure 7:
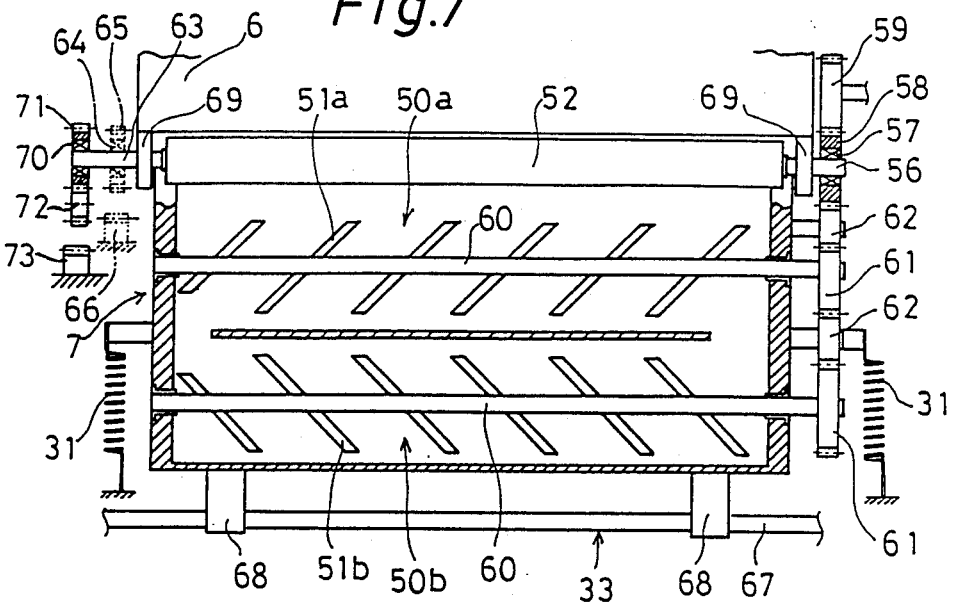
FIG. 7 is a transverse sectional plan view showing a state when a developing unit is at a location of operation of a developing position.

Stirring means 51*a*, 51*b* and developing roll 52 are driven from the side of the main body of the machine. As shown in FIG. 7, a developing roll gear 58 is mounted on a driving shaft 56 extended from one end of a developing roll 52 through a one way clutch 57, and is engaged with a driving gear 59 of the main body of the machine under a state that the developing unit 7 is positioned at a developer supply location. Bucket gears 61 are also fixed to one end portion of driving shafts 60 of the stirring means 51*a*, 51*b* respectively, and the developing roll gear 58 and the bucket gear 61 are interlocked through an idle gear 62 so as to rotate in the same direction.

A transmission gear 71 is provided on a shaft 63 extended from another end portion of the developing roll 52 through one way clutch 70, and an idle gear 72 which engages with the transmission gear is also provided. There is also disposed a rack 73 in the vertical direction which engages with the idle gear 72 under the state that the developing unit 7 is positioned at a retreated position, and is fixed to the main body of the machine.

Figure 8:
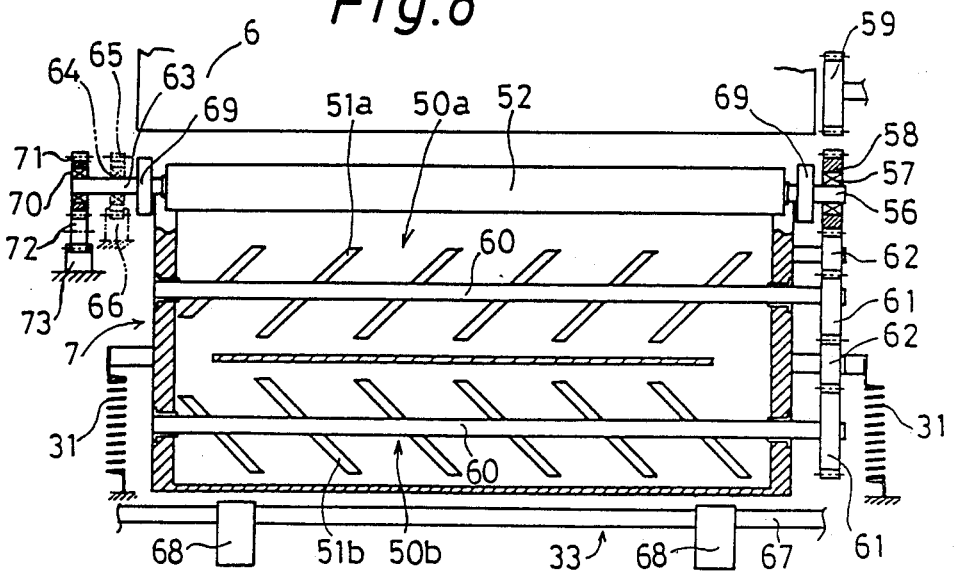
FIG. 8 is a transverse plan view showing a state when a developing unit is not at a location of operation of a developing position.

In FIGS. 7 and 8, a simplified position switching means 33 is shown which is arranged to advance the developing unit 7 by directly pressing the unit 7 with an eccentric cam 68 fixed to a drive operating shaft 67.

Now, a function of the device will be described. The elevation support member 15 is first raised from the lowermost position to have a desired color developing unit 7 positioned opposite to the photoconductor 6, and the developing unit 7 is moved forward to be positioned at a developer supply location by the position switching means 33. Then, as shown in FIG. 7, the developing roll gear 58 is engaged with the driving gear 59 to rotate the developing roll 52 and the stirring means 51*a*, 51*b* in the bucket sections 50*a*, 50*b*.

Figure 9:
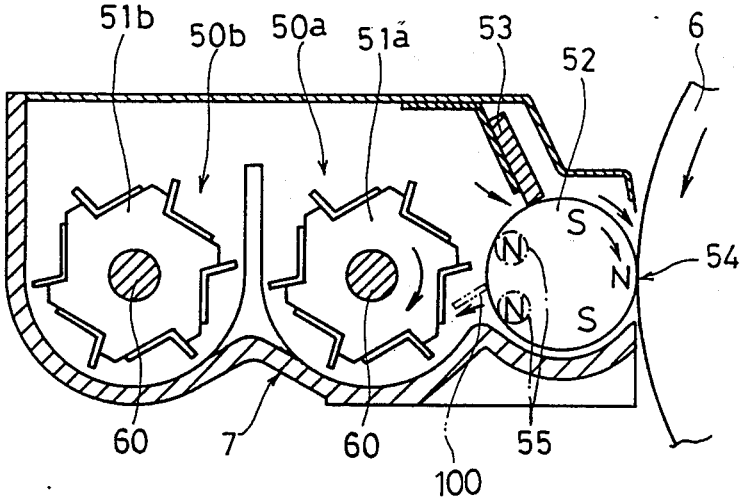
FIG. 9 is an expanded sectional view showing a state when a developing unit is at a location of operation of a developing position.

As a result, the developer is stirred and circulated in the bucket sections 50*a*, 50*b* and supplied to the developing roll 52 as shown in FIG. 9 where the height of the developer is regulated by a height regulating plate 53 and the developer is fed to a developing section 54. A latent image on the photoconductor 6 is thus visualized by toner, and the visualized toner image is transferred onto a copy paper on a transfer drum 8. The developer after developing process is removed at a non-magnetic section 55 of the developing roll 52 and is returned to the bucket section 50*a*.

When the developing process is finished by the developing unit 7, the developing unit 7 is released from the pressure of the position switch means 33 and is moved backward by a spring 31. Then, as shown by the solid line in FIG. 7, the engagement of the driving gear 59 with the developing roll gear 58 is released and the developing roll 52 and the stirring means 51*a*, 51*b* are stopped.

Figure 6:
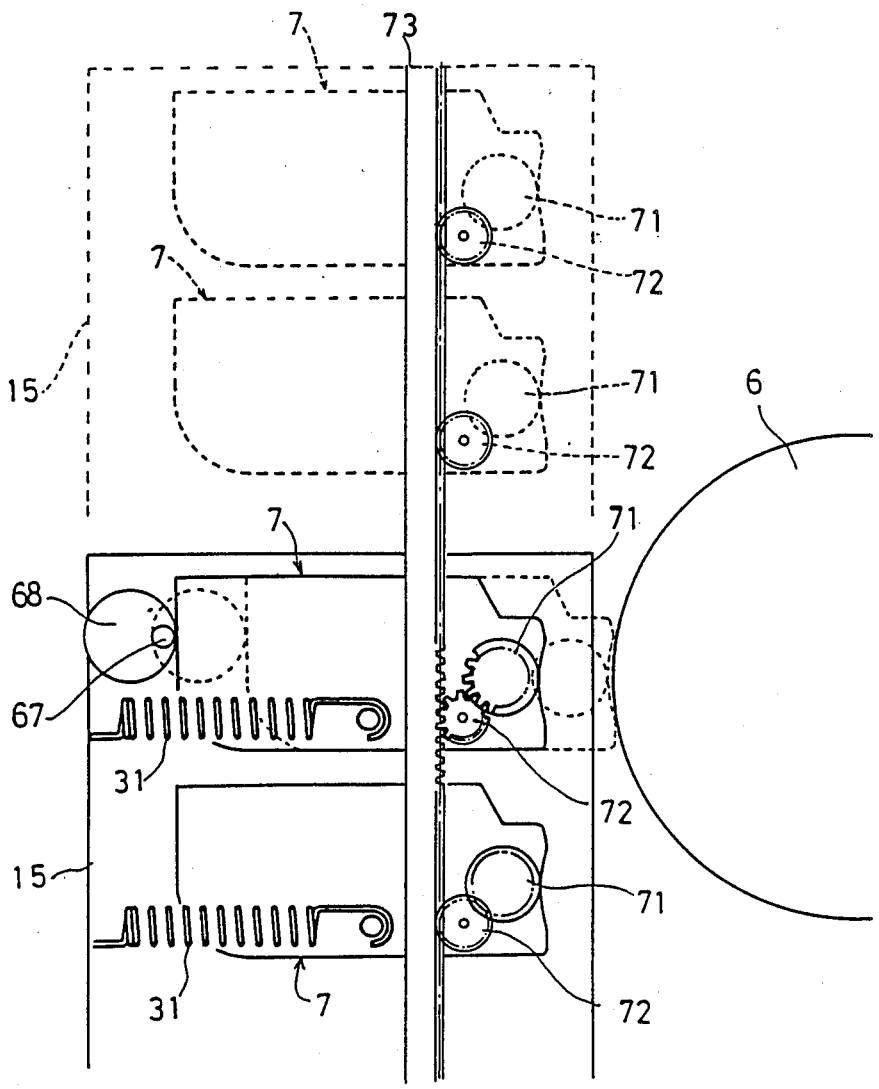
FIG. 6 is a side view of the upper half portion of a developing device illustrating a second embodiment of the present invention.
Figure 10:
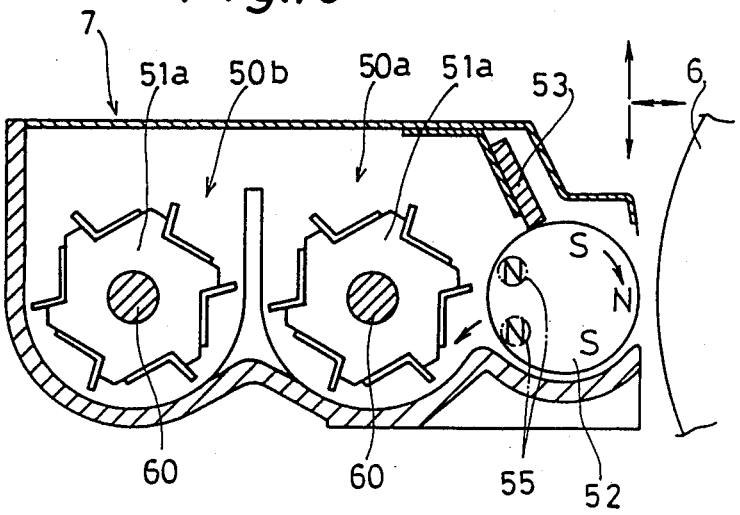
FIG. 10 is an expanded sectional view showing a state when a developing unit is not at a location of operation of a developing position.

On the other hand, the idle gear 72 is engaged with a rack 73 by the backward movement of the developing unit 7 as shown in FIGS. 6 and 8. Under the state, when an elevation support member 15 is moved, for instance, upwardly in order to have a developing unit 7 positioned opposite to the photoconductor 6, the transmission gear 71 starts rotation through the idle gear 72, and the developing roll 52 starts rotation through a one way clutch 70. At this stage, the driving shaft 56 also starts rotation, however, rotative force is not transmitted to the developing roll gear 58 since a one way clutch 57 is provided thereat and the stirring means 51*a*, 51*b* are thus not rotated. As a result, the developing roll 52 is rotated in the direction of the arrow as shown in FIG. 10 under a state that developer is not supplied from the bucket section 50*a*, and the developer held on the developing roll 52 with ordinary height is removed by passing through the non-magnetic section 55 thereby causing the height of the developer to be lowered.

In the same manner as above-mentioned, when the next developing unit 7 is moved backward and starts upward movement the height of developer on the developing roll 52 is lowered. Incidentally, when the elevation support member 15 moves downward, the developing roll 52 is not reversely rotated even if the transmission gear 71 is reversely rotated since a one way clutch is not provided. Accordingly, even when the developing unit 7 is moved again to the position opposite to the photoconductor 6 and is advanced to the developer supply location, the developer is held on the developing roll 52 with an ordinary height so that bad effects can be avoided.

In the above-mentioned embodiment, the developing roll 52 is arranged to rotate only when the elevation support member 15 moves upwardly, however, as shown in FIG. 7, the developing roll 52 can be arranged to rotate in the same direction even when the elevation support member 15 moves downwardly by providing a second transmission gear 65 on the shaft 63 through one way clutch 64 with a second rack 66 to which the transmission gear 65 is engaged when the developing unit 7 moves backward.

In the case when the height can be lowered without rotating the developing roll 52 many times, the rack 66,73 may be provided at the position adjacent to and facing the photoconductor 6, and at the other positions, it may be arranged to drive the stirring means 51*a*, 51*b*. Instead of making use of the non-magnetic section 55 of the developer detaching function for lowering the height of the developer as described in the second embodiment of the present invention, a scraper 100 may be provided as shown by phantom line in FIG. 9. Needless to say the driving means of the developing roll 52 and stirring means 51*a*, 51*b* may optionally be changed.

Moreover, the present invention may be applied to a moving method such as rotary method not limiting to the elevation method. Not limiting to a color copying machine wherein an electrostatic latent image is composed corresponding to each color as described in the above embodiment, it may also be applied to a multicolor copying machine wherein a plurality of developing units accommodating different colored developers are selectively used for visualizing the electrostatic latent images formed separately without having color decomposition.

The shutter in the first embodiment of the present invention may be actuated correlatively with the movement of each developing unit between the developing location and non-developing position, and the developing sleeve in the second embodiment of the present invention may be actuated correlatively with the movement of the developing unit on the support member.

The present invention may also be applied to the case when a rotary support member is used for selectively moving each developing unit to the developing position. Moreover, in the present invention, any moving method may be adopted for movement of each developing unit between a position adjacent to a photoconductor, i.e. an image support member and a position away from the image support member.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device for developing an electrostatic latent image on an image support member, comprising:

a plurality of developing units having developing rolls which are rotatively driven for supplying different colored developers to the image support member;

a position changeover means for switching over positions of each developing unit between a developer supply location adjacent to the image support member and a developer non-supply position away from the image support member;

a developer condition regulating means for regulating the condition of developer on the developing roll to lower the height of the developer at least at the portion where the developing roll faces the outside of the developing unit; and an interlocking means for actuating or stopping the action of the developer regulating means correlatively with the movement of each developing unit between the developer supply location and the developer non-supply position.

2. A developing device as claimed in claim 1, wherein the position changeover means comprises:

a movable support member supporting each developing unit and being movable in a predetermined direction for selectively switching over the position of one of the developing units to the developing location opposite to the image support member, and a mechanism of forward and backward movement of a developing unit for advancing on the movable support member a developing unit at the developing location to the developer supply location adjacent to the image support member and for moving backward the unit from the location.

3. A developing device as claimed in claim 2, wherein the interlocking means actuates or stops the action of the developer condition regulating means correlatively with the movement of the movable support member.

4. A developing device as claimed in claim 2, wherein the interlocking means actuates or stops the action of the developer condition regulating means correlatively with the forward and backward movement of a developing unit on the movable support member.

5. A developing device for developing an electrostatic latent image on an image support member, comprising:

a plurality of developing units for supplying different colored developers to the image support member, each developing unit having a rotatively driven developing roll and a developer stirring means for stirring and supplying developer to the image support member;

a developing unit support member for movably supporting each developing unit between a developer supply location adjacent to the image support member and a developer non-supply position away from the image support member;

a position changeover means for moving each developing unit between the developer supply location and the developer non-supply position;

a shutter for regulating supply of developer to the developing roll; and an interlocking means for switching over the shutter positions where supply of developer is carried out or regulated correlatively with the movement of each developing unit between the developer supply location and the developer non-supply position.

6. A developing device as claimed in claim 5, wherein the shutter is moved to approach or contact the circumferential surface of the developing roll at the position where supply of developer is regulated.

7. A developing device as claimed in claim 5, wherein the position changeover means comprises:

a support member moving mechanism for moving the developing unit support member in a predetermined direction and for selectively moving one of the developing units to the developing location opposite to the image support member; and a mechanism of forward and backward movement of a developing unit for advancing on the developing unit support member a developing unit at the developing location to the developer supply location adjacent to the image support member and for moving backward the unit from the location.

8. A developing unit as claimed in claim 7, wherein the developing unit support member moving mechanism causes the support member to reciprocate in the vertical direction.

9. A developing device as claimed in claim 7, wherein the interlocking means switches over the shutter to regulating or non-regulating position correlatively with the forward and backward movement of a developing unit on the support member.

10. A developing device as claimed in claim 9, wherein the interlocking means comprises:

an energizing member for energizing the shutter at either one of regulating or non-regulating positions, and a stopper for regulating the movement of the shutter corresponding to the forward or backward position of a developing unit on the support member.

11. A developing device as claimed in claim 10, wherein the shutter is pivotally supported by a developing unit and is switched over to the regulating or non-regulating position with the shutter being energized by the energizing member to the side of the regulating position, and the stopper being provided on the support member for stopping the shutter at the position corresponding to the forward and back movement of a developing unit.

12. A developing device for developing an electrostatic latent image on an image support member, comprising:

a plurality of developing units for supplying different colored developers to the image support member, each developing unit have a rotatively driven developing roll and a developer stirring means for stirring and supplying developer to the image support member;

a position changeover means for switching over positions of each developing unit between a developer supply location adjacent to the image support member and a developer non-supply position away from the image support member;

a developer detaching means for detaching the developer supplied onto the surface of a developing roll;

a first interlocking means for connecting or disconnecting both the developing roll and the stirring means with a driving means correlatively with the movement of a developing unit between a developer supply location and a developer non-supply position; and a second interlocking means for rotating the developing roll correlatively with the movement of a developing unit to the developer non-supply position, the rotation being carried out until the developer detached portion reaches at least at the position where the developing roll faces the outside of the developing unit.

13. A developing device as claimed in claim 12, wherein the developer detaching means is a non-magnetic portion arranged in a magnet member provided in the developing roll where developer is magnetically held on the developing roll.

14. A developing device as claimed in claim 12, wherein the position changeover means comprises:

a movable support member supporting each developing unit and being moved in a predetermined direction for selectively switching over the position of each developing unit to the developing location opposite to the image support member; and a mechanism of forward and backward movement of a developing unit for advancing on the movable support member a developing unit at the developing location to the developer supply location adjacent to the image support member and for moving backward the unit from the location.

15. A developing device as claimed in claim 14, wherein the first interlocking means performs engagement or disengagement correlatively with the forward and backward movement of a developing unit on the support member.

16. A developing device as claimed in claim 15, wherein the first interlocking means is provided with a developing gear connected to a developing roll through a one way clutch and also to the developer detaching means without a clutch, and the gear is engaged or disengaged with a driving gear positioned at a predetermined location correlatively with the movement of a developing unit.

17. A developing device as claimed in claim 14, wherein the second interlocking means is caused to be operable or inoperable correlatively with the forward and backward movement of a developing unit on the support member and is actuated correlatively with the movement of a developing unit from the developing location to the non-developing position.

18. A developing device as claimed in claim 17, wherein the second interlocking means comprises:

a rack provided at a predetermined position along the direction of movement of a developing unit by the support member; and a gear connected to a developing sleeve through a one way clutch for engaging and disengaging with the rack correlatively with forward and backward movement of a developing unit on the support member.

* * * * *

UNITED STATES PATENT AND TRADEMARK OFFICE

CERTIFICATE OF CORRECTION

PATENT NO. : 4,928,146

DATED : May 22, 1990

INVENTOR(S) : Takanobu Yamada

It is certified that error appears in the above-identified patent and that said Letters Patent is hereby corrected as shown below:

In col. 2, line 39, change "magenets" to --magnets--.

In col. 3, line 50, change "description" to --descriptions--.

In col. 6, line 4, before "positioned", insert --be--.

In col. 6, line 17, change "deloper" to --developer--.

In col. 6, line 65, change "covered" to --lowered--.

In col. 11, line 23 (claim 12, line 6), change "have" to --having--.

Signed and Sealed this

Seventeenth Day of September, 1991

*Attest:*

HARRY F. MANBECK, JR.

*Attesting Officer*

*Commissioner of Patents and Trademarks*